US006145684A

United States Patent [19]

Olden

[11] Patent Number: 6,145,684

[45] **Date of Patent: *Nov. 14, 2000**

[54] APPARATUS FOR CRATING ELONGATE ITEMS SUCH AS TUBS

[75] Inventor: Michael Marc Olden, Pacific, Mo.

[73] Assignee: MiTek Holdings, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,630

[22] Filed: May 7, 1997

[51] Int. Cl.[7] ..... B65D 19/00

[52] U.S. Cl. ..... 220/6; 217/15; 217/38; 217/47

[58] Field of Search ..... 220/6; 217/15, 217/38, 47

[56] References Cited

U.S. PATENT DOCUMENTS

| | | | |
|---|---|---|---|
| 576,098 | 2/1897 | Dunbar | 217/38 |
| 1,382,178 | 6/1921 | Dultmeier | 217/15 |
| 2,267,972 | 12/1941 | Carroll | 217/47 |
| 2,525,838 | 10/1950 | Smith et al. | 220/6 X |
| 2,586,251 | 2/1952 | Peebles | 220/6 X |
| 3,527,339 | 9/1970 | Cipolla | 220/6 X |
| 4,120,417 | 10/1978 | Aquino | 220/6 |
| 5,386,919 | 2/1995 | Long | 220/6 X |
| 5,661,930 | 9/1997 | Porter | 220/6 X |

*Primary Examiner*—Steven Pollard
*Attorney, Agent, or Firm*—Armstrong Teasdale LLP

[57] ABSTRACT

In one aspect, the present invention relates to a crate subassembly including four support cords with connector plates securing respective adjacent cords. More particularly, the connector plates extend over the interfaces between adjacent cords, and the connector plates secure adjacent cords together so as to prevent relative lateral movement between adjacent cords yet allow relative rotational movement of the cords as described below. By simply separating opposing cords, the subassembly can be easily and quickly opened. Specifically, the connector plates flex, or bend, and the connector plates have sufficient rigidity so that once opened, the subassembly does not close on itself during handling. Also, notches are formed between adjacent cords, and these notches are utilized when forming a crate as described below. To form a crate, and in an exemplary configuration, three subassemblies are positioned in a spaced relationship, and girders are positioned to extend through respective notches in each subassembly. The girders may, for example, be secured to each subassembly using screws which pass through the girder and into one of cords. In this manner, a crate for an elongate object such as a tub is easily and quickly assembled.

12 Claims, 2 Drawing Sheets

APPARATUS FOR CRATING ELONGATE ITEMS SUCH AS TUBS

FIELD OF THE INVENTION

This invention relates generally to packaging elongate items such as tubs and, more particularly, to methods and apparatus for packaging such items in crates.

BACKGROUND OF THE INVENTION

Elongate rigid items such bath tubs, and elongate flexible items such as siding and steel roofing, generally require special packaging in order to ensure that such items do not become damaged during handling and shipment. With a bath tub, for example, the tub is highly susceptible to damage and the tub packaging must provide sufficient rigidity and strength to protect the tub against damage.

In one known packaging method, a crate is built around the tub by using cords of wood stapled together. Typically, and to increase productivity, two workers having staple guns assemble the crate. At various times during the crate assembly process, one worker will be shooting staples into the cords in a direction toward the other worker. Of course, workers recognize the hazard and wear protective clothing and eye protection. In spite of the precautions and protection measures, having one worker shoot staples in the direction of another worker remains hazardous and it would be desirable to eliminate this situation. In addition, having workers assigned to building such crates is expensive in terms of labor costs. Further, since staples are used in the assembly process, such crates generally are not reusable and typically are discarded after one delivery.

Accordingly, it would be desirable to provide methods and apparatus which enable safe, easy, and fast assembly of sturdy and reusable crates for elongate items such as tubs. It also would be desirable to provide a crate subassembly which is low in cost and does not easily collapse during assembly.

SUMMARY OF THE INVENTION

These and other objects may be attained by a crate which includes a crate subassembly constructed in accordance with the present invention. Particularly, in one aspect, the present invention relates to a crate subassembly which includes four support cords with connector plates securing respective adjacent cords. More particularly, the connector plates extend over the interfaces between adjacent cords, and the connector plates secure adjacent cords together so as to prevent relative lateral movement between adjacent cords yet allow relative rotational movement of the cords as described below.

By simply separating opposing cords, the subassembly can be easily and quickly opened. Specifically, the connector plates flex, or bend, and the connector plates have sufficient rigidity so that once opened, the subassembly does not close on itself during handling. Also, notches are formed between adjacent cords, and these notches are utilized when forming a crate as described below.

In another aspect, the present invention relates to a crate fabricated using the above described subassembly. More particularly, and in one embodiment, a crate is formed by positioning at least two subassemblies in a spaced relationship, and girders are positioned to extend through respective notches in each subassembly. The girders may, for example, be secured to each subassembly using screws which pass through the girder and into one of cords. In this manner, a crate for an elongate object such as a tub is easily and quickly assembled.

The above described subassembly enables safe, easy, and fast assembly of sturdy and reusable crates. In addition, such subassembly is low in cost and does not easily collapse.

DETAILED DESCRIPTION

Figure 1:
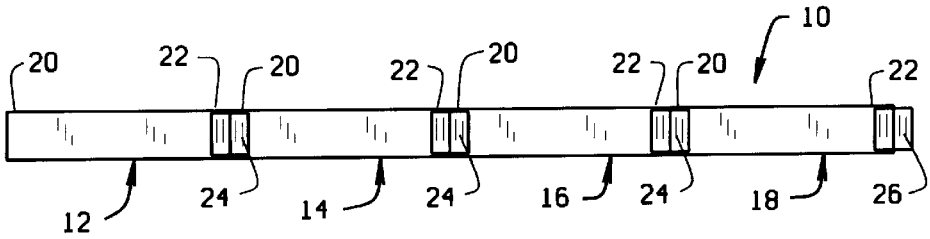
FIG. 1 is a top plan view of a crate subassembly constructed in accordance with one embodiment of the present invention.

FIG. 1 is a top plan view of a crate subassembly 10 constructed in accordance with one embodiment of the present invention. Crate subassembly 10 includes four support cords 12, 14, 16, and 18 having opposing first and second ends 20 and 22. Cords 12 and 18 are sometimes referred to herein as end cords and cords 14 and 16 are sometimes referred to herein as intermediate cords. Cords 12, 14, 16, and 18 are approximately about equal in length.

Cords 12, 14, 16, and 18 typically are fabricated from wood (e.g., plywood) such as 1"×4" or 2"×4" boards. Of course, the specific dimensions of cords 12, 14, 16, and 18 are selected based on the desired size and strength of the crate. The strength of a crate sometimes is referred to as the "burst" strength of the crate, and cords 12, 14, 16, and 18 are selected to satisfy the particular burst requirements for the crate to be constructed.

In addition, and with respect to spacing between adjacent cords 12, 14, 16, and 18, such cords 12, 14, 16, and 18 can be spaced apart in a range, for example, of approximately about 0" to 0.5", although it is contemplated that in some applications the spacing may be greater. Even with no spacing, i.e., spacing of 0", it has been found that cords 12, 14, 16, and 18 may rotate relative to each other to form a crate as described below. The spacing between cords 12, 14, 16, and 18 is selected based on the desired strength of the crate.

Referring still specifically to the exemplary embodiment illustrated in FIG. 1, connector plates 24 are located to connect respective adjacent cords 12, 14, 16, and 18. More particularly, connector plates 24 extend over the interfaces between adjacent cords 12, 14, 16, and 18 and connector plates 24 secure adjacent cords 12, 14, 16, and 18 together so as to prevent relative lateral movement between adjacent cords 12, 14, 16, and 18 yet allow relative rotational movement of cords 12, 14, 16, and 18 as described below. In addition, a free end connector plate 26 is located over and extends from end cord 18. As described below, free end connector plate 26 is utilized to complete the formation of subassembly 10.

Connector plates 24 and 26 are well known in the art, and the present invention is not limited to practice with any one particular connector plate. In an exemplary embodiment, connector plates are the plates generally referred to as MII 20 connector plates 24 and 26 commercially available from MiTek Industries, Inc., St. Louis, Mo. The particular plate selected depends on the size and strength of the crate to be formed. For example, the MII 20 connector plate is a "20 gauge" plate, and for some crates, other gauge connectors (e.g., 18 or 16 gauge connectors) may be required.

With respect to fabrication of subassembly 10, cords 12, 14, 16, and 18 are pre-cut and then arranged on a work table relative to connector plates 24 in the arrangement shown in FIG. 1. Particularly, cords 12, 14, 16, and 18 are positioned end to end and connector plates 24 are located at the interfaces between cords 12, 14, 16, and 18 as described above. In addition, free end connector plate 26 is positioned as shown and described in connection with FIG. 1. The arrangement is then located under a vertical press, such as the Mark 100 vertical press commercially available from MiTek Industries, Inc., St. Louis, Mo. The press is then lowered so that connector plates 24 and 26 partially extend into and securely engage cords 12, 14, 16, and 18. The press plate is then lifted.

Figure 2:
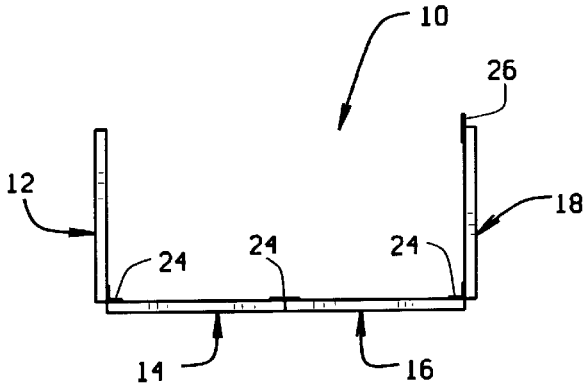
FIG. 2 is a side view of the crate subassembly shown in FIG. 1 in a partially folded condition.
Figure 3:
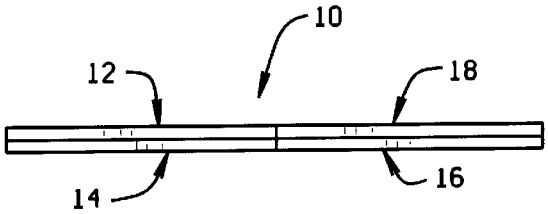
FIG. 3 is a side view of the crate subassembly shown in FIG. 1 in a completely folded condition.

After connector plates 24 and 26 are pressed into engagement with cords 12, 14, 16, and 18 as described above, and referring now to FIGS. 2 and 3, end cords 12 and 18 are folded (FIG. 2) over intermediate cords 14 and 16 until end cords 12 and 18 are resting over intermediate cords 14 and 16 (FIG. 3). In this position, free end connector plate 26 extends across the interface between now adjacent end cords 12 and 18. The press is then lowered to press folded subassembly 10 so that free end connector plate 26 securely engages end cords 12 and 18 to complete fabrication of subassembly 10.

The pressing operation for the folded subassembly can be performed simultaneously with the initial pressing operation. For this simultaneous pressing, the work table (or fixture) includes a stepped surface, and a folded subassembly is located on the lower fixture surface and an unfolded subassembly is located on the upper fixture surface so that the uppermost surface of the folded subassembly lies on substantially the same plane as the uppermost surface of the unfolded subassembly. As a result, when the press is lowered, the press simultaneously engages both the folded and unfolded subassemblies. In addition, other presses such as a roller press can be used to perform the above described pressing operation.

Figure 4:
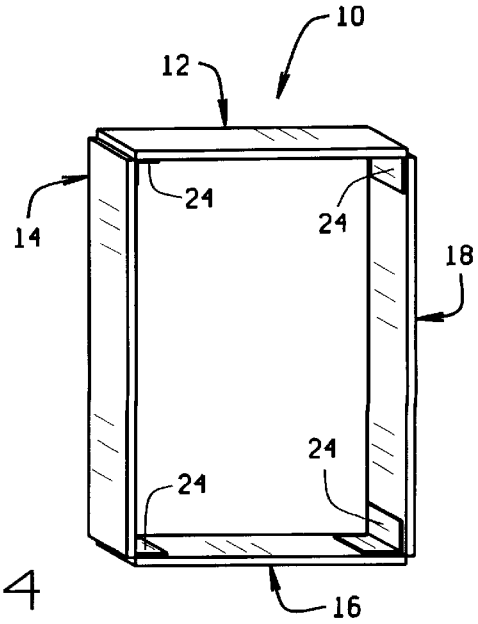
FIG. 4 is a perspective view of the crate subassembly shown in FIG. 1 in a completely open condition.

FIG. 4 is a perspective view of subassembly 10 in the open condition. By simply separating opposing cords 12, 16, and 14, 18, subassembly 10 can be easily and quickly opened. Connector plates 24 and 26 flex, or bend, and connector plates 24 and 26 have sufficient rigidity so that once opened, subassembly 10 does not close on itself during handling. As shown in FIG. 4, notches 28 are formed between adjacent cords 12, 14; 14, 16; 16, 18; and 18 12, and notches 28 are utilized when forming a crate as described below.

Figure 5:
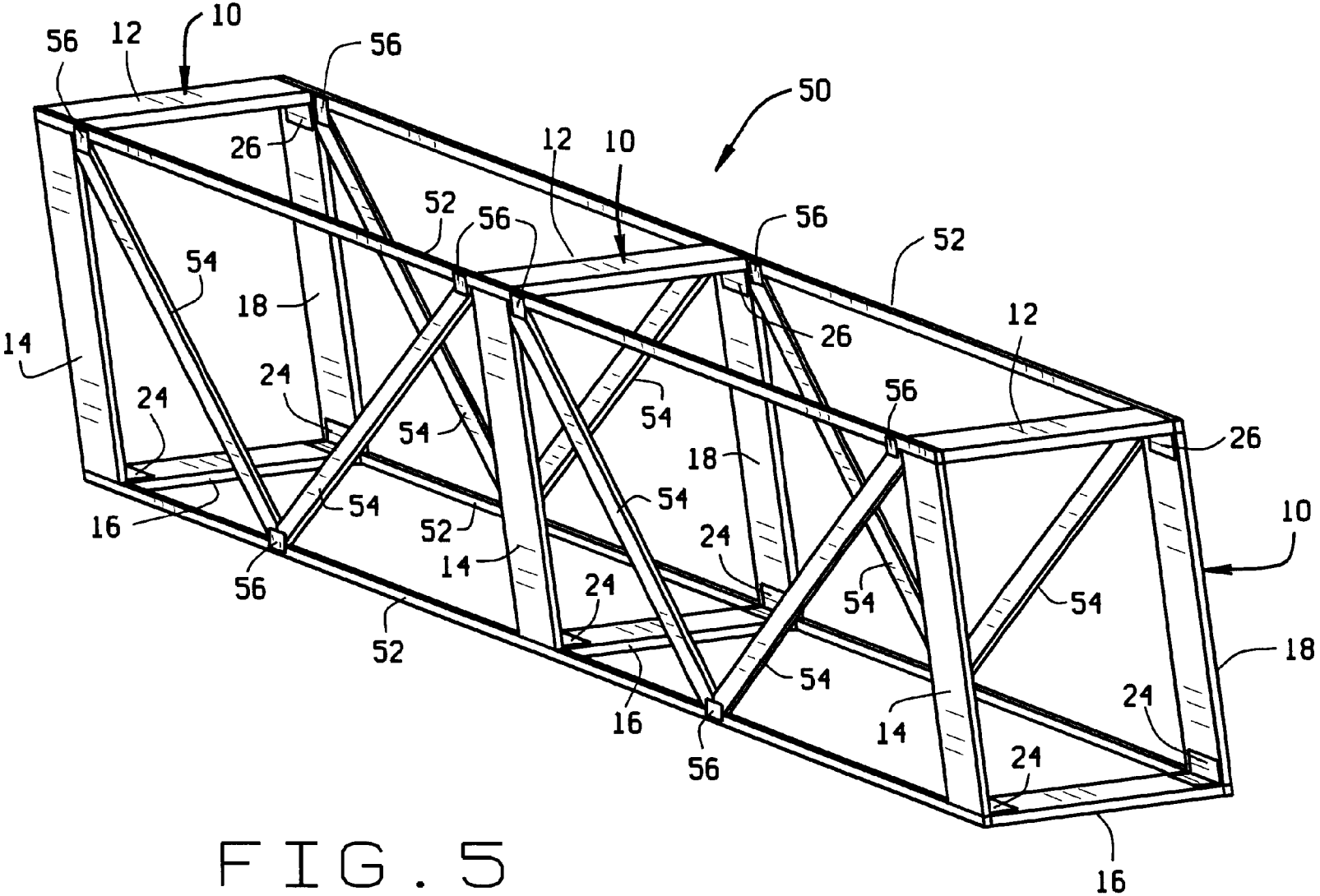
FIG. 5 is a perspective view of a crate constructed using three crate subassemblies in accordance with the present invention.

More particularly, and referring to FIG. 5 which is a perspective view of an exemplary crate 50 constructed using three crate subassemblies 10, such subassemblies 10 are readily secured to girders 52 which extend through respective notches 28 in each subassembly 10. Girders 52 may, for example, be 2"×4" boards and secured to each subassembly 10 using screws which pass through each respective girder 52 and into one of cords 12, 14, 16, or 18. Extra rigidity can be provided by securing support boards, or supports, 54 between girders 52. Supports 54 may, for example, be 2"×4" boards and, in the exemplary configuration, are secured to girders 52 by connector plates 56. In this manner, crate 50 for an elongate object such as a tub is easily and quickly assembled.

Of course, various size crates can be constructed using any number of subassemblies 10. Therefore, although three subassemblies 10 are used to construct exemplary crate 10, many other configurations are possible. Subassembly 10 enables safe, easy, and fast assembly of sturdy and reusable crates. In addition, such subassembly 10 is low in cost and does not easily collapse during handling and assembly to a crate.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A crate subassembly, comprising:

a plurality of support chords having opposing first and second ends; and at least one connector plate, each said connector plate extending over an interface between adjacent chords and embedded at least partially into said chords adjacent said interface connecting said adjacent chords, said connector plate having a planar configuration when embedded into said adjacent chords and subsequently bent to form a desired shape of said crate subassembly.

2. A crate subassembly in accordance with claim 1 wherein said at least one connector plate prevents substantial relative lateral movement between said two connected cords and allows relative rotational movement of at least one of said connected cords relative to said other connected cord.

3. A crate subassembly in accordance with claim 1 wherein said cords are approximately about equal in length.

4. A crate subassembly in accordance with claim 1 comprising four support cords, each said support cord interconnected to at least one of said other support cords by a connector plate.

5. A crate subassembly in accordance with claim 4 further comprising a notch between adjacent ones of said cords.

6. A crate, comprising:

at least two crate subassemblies, each said crate subassembly comprising a plurality of support chords having opposing first and second ends, and at least one connector plate, each said connector plate extending over an interface between adjacent chords and embedded at least partially into said chords adjacent said interface connecting said adjacent chords, said connector plate having a planar configuration when embedded into said adjacent chords and subsequently bent to form a desired shape of said crate subassembly; and at least one girder extending between and connected to said crate subassemblies.

7. A crate in accordance with claim 6 wherein said at least one connector plate prevents substantial relative lateral movement between said two connected cords and allows relative rotational movement of at least one of said connected cords relative to said other connected cord.

8. A crate in accordance with claim 6 wherein said cords of at least one of said subassemblies are approximately about equal in length.

9. A crate in accordance with claim 6 wherein each said subassembly comprises four support cords, each said support cord of each said subassembly interconnected to at least one of said other support cords of said subassembly by a connector plate.

10. A crate in accordance with claim 9 wherein each subassembly further comprises a notch between adjacent ones of said cords.

11. A crate in accordance with claim 10 wherein a portion of said girder is located in one of said notches in one of said subassemblies and another portion of said girder is located in one of said notches in another one of said subassemblies.

12. A crate in accordance with claim 6 further comprising at least two girders extending between and connected to said crate subassemblies and at least one support board extending between and secured to said two girders.

* * * * *